US010376896B2

(12) United States Patent
Pallmann

(10) Patent No.: US 10,376,896 B2
(45) Date of Patent: Aug. 13, 2019

(54) DISC CHIPPER FOR CRUSHING LUMPY FEED MATERIAL, PARTICULARLY WOOD

(71) Applicant: PALLMANN MASCHINENFABRIK GmbH & Co. KG, Zweibruecken (DE)

(72) Inventor: Hartmut Pallmann, Zweibruecken (DE)

(73) Assignee: PALLMANN MASCHINENFABRIK GmbH & Co. KG, Zweibruecken (DE)

( * ) Notice: Subject to any disclaimer, the term of this patent is extended or adjusted under 35 U.S.C. 154(b) by 537 days.

(21) Appl. No.: 15/151,956

(22) Filed: May 11, 2016

(65) Prior Publication Data

US 2016/0332323 A1 Nov. 17, 2016

(30) Foreign Application Priority Data

May 11, 2015 (DE) ..... 10 2015 005 859

(51) Int. Cl.

| | |
|---|---|
| ***B02C 18/00*** | (2006.01) |
| ***B02C 18/14*** | (2006.01) |
| ***B27L 11/00*** | (2006.01) |
| ***B27L 11/02*** | (2006.01) |
| ***B02C 18/08*** | (2006.01) |
| *B02C 18/18* | (2006.01) |

(52) U.S. Cl.

CPC ..... *B02C 18/143* (2013.01); *B02C 18/083* (2013.01); *B02C 18/14* (2013.01); *B27L 11/005* (2013.01); *B27L 11/02* (2013.01); *B02C 18/18* (2013.01)

(58) Field of Classification Search

CPC ... B02C 18/143; B02C 18/144; B02C 18/083; B27L 11/005

USPC ..... 241/144, 145, 242, 243

See application file for complete search history.

(56) References Cited

U.S. PATENT DOCUMENTS 257,252 A * 5/1882 Strasser ..... B02C 17/161 241/69
3,746,269 A 7/1973 Maier
3,850,364 A * 11/1974 Robbins ..... B02C 18/14 241/101.78

(Continued)

FOREIGN PATENT DOCUMENTS

DE 2 031 635 A 1/1971
DE 2 131 262 A1 2/1972

(Continued)

*Primary Examiner* — Faye Francis

(74) *Attorney, Agent, or Firm* — Muncy, Geissler, Olds & Lowe, P.C.

(57) ABSTRACT

A disc chipper for crushing lumpy feed material. The disc chipper has a crushing rotor driven by a drive unit, rotating about an axle, including a rotor shaft and a chipping disc connected in a rotationally fixed manner with the rotor shaft. The chipper disc includes chipping knives, which are transversely aligned in the disc plane to the rotational direction and which cooperate with stationary counter knives for the comminution of the feed material. The drive unit include a primary drive and a secondary drive, which drive the crushing rotor via a transmission, wherein the primary drive is in active operative connection with the crushing rotor during the crushing operation, and the secondary drive during the acceleration process or when readjusting the crushing rotor for purposes of maintenance and repair.

16 Claims, 5 Drawing Sheets

(56) References Cited

U.S. PATENT DOCUMENTS 5,076,504 A * 12/1991 Young ..... A23N 17/002 241/101.78
5,205,498 A * 4/1993 Ostermeier ..... A01G 3/002 144/176
5,293,917 A 3/1994 Kalliokoski
6,257,511 B1 * 7/2001 Turner ..... B02C 18/143 241/296
6,409,111 B1 * 6/2002 Kokko ..... B02C 18/083 241/242
7,168,640 B2 1/2007 Lipowski
7,703,714 B2 * 4/2010 Becker ..... B02C 18/18 241/242
7,798,436 B2 * 9/2010 Cornelius ..... A01G 3/002 241/298
8,051,887 B2 * 11/2011 Robinson ..... B27L 11/005 144/162.1
8,281,826 B2 * 10/2012 Uelmen ..... B27L 11/005 144/162.1
9,204,659 B2 * 12/2015 Lee ..... A47J 43/0722
2005/0023388 A1 * 2/2005 Reinhold ..... B02C 18/083 241/92
2009/0200411 A1 * 8/2009 Stager ..... B27L 11/005 241/296
2009/0320696 A1 * 12/2009 Herren ..... A47J 43/105 99/493
2011/0100511 A1 * 5/2011 Robinson ..... B27L 11/005 144/373
2011/0114222 A1 * 5/2011 Maietta ..... B27L 11/005 144/176
2014/0138464 A1 * 5/2014 Casper ..... B02C 18/145 241/28

FOREIGN PATENT DOCUMENTS

DE 73 26 930 U 10/1973
DE 42 38 089 A1 5/1993
DE 103 33 359 B3 1/2005
DE 10 2007 009 657 B3 10/2008

* cited by examiner

DISC CHIPPER FOR CRUSHING LUMPY FEED MATERIAL, PARTICULARLY WOOD

This nonprovisional application claims priority under 35 U.S.C. § 119(a) to German Patent Application No. 10 2015 005 859.2, which was filed in Germany on May 11, 2015, and which is herein incorporated by reference.

BACKGROUND OF THE INVENTION

Field of the Invention

The invention relates to a disc chipper for crushing lumpy feed material, particularly wood.

Description of the Background Art

Disc chippers are generally known and are used to produce wood chips from lumpy feed material such as timber or residual wood chips in order to produce wood chips as raw material for further industrial use. A large proportion of the produced wood chips is supplied to a thermal utilization system, i.e., the wood chips are burned as renewable fuel in thermal power stations or private households. In addition, the use of the wood chips for the production of high-quality wood products such as MDF and chipboard is of interest. A prerequisite for this is that the chips thus produced meet predetermined quality features in terms of size, shape and surface texture of the wood chips.

From the German disclosure 2 031 635, a disc chipper is known with a chipping disc rotating within a housing and equipped with knives. The chipper disc is seated rotationally fixed on a shaft, which is driven by an electric motor via a reduction gear. The feed material is fed to the chipping disc over lateral chutes at an acute angle to the disc plane.

In DE 42 38 089 A1, which corresponds to U.S. Pat. No. 5,293,917, a disc chipper for the production of chips is described, having as a comminution unit a cutting disc with knives which rotates about a horizontal axis. The feed material is supplied to the disc in a feed angle of a maximum of 34° in order to obtain an improved chip quality.

SUMMARY OF THE INVENTION

It is therefore an object of the invention to provide a disc chipper with which high-quality chips can be cost-effectively produced.

A first advantage of a disc chipper according to the invention results from a drive unit with a primary drive, which is responsible for driving the crushing rotor during the crushing operation, and a secondary drive, which drives the rotor in all other cases. In this way, it is possible to align in a targeted manner the primary drive to the specific needs of the crushing operation. For example, the primary drive can have an output of between 450 kW and 1500 kW, preferably between 900 kW and 1400 kW, in order to guarantee a constant rotation also of large chipping discs.

By contrast, the secondary drive assumes the drive during acceleration, deceleration or the gradual adjustment of the rotor, and in turn can be adapted to the specificities of these operations. For the acceleration of the chipping disc, a secondary drive with an output between 25 kW and 75 kW is preferred, in particular between 35 kW and 55 kW, so that the secondary drive can be selected to be comparatively small with the advantage of lower costs.

With regard to an exemplary embodiment of the invention, a ratio of power of the primary drive to the output of the secondary drive in a range between 10 and 35, preferably between 20 and 3, has been found to be beneficial.

Particularly in chipping discs with large diameters and large weight, this advantage is particularly evident, since due to the inertia of the rotor, the acceleration and deceleration forces are enormous. Such chipping discs may, for example, have a diameter of more than 2 m and/or a weight of more than 5,000 kg, in particular more than 7,500 kg, preferably more than 10,000 kg.

The secondary drive can comprise a hydraulic motor, which already during starting of the rotor provides a maximum torque and allows for an exact positioning of the rotor during readjustment of the rotor for maintenance and repair work, for example, during the gradual adjustment of the rotor into the blade changing position for changing the chipping knives. For braking the chipping disc, the hydraulic motor can pump the hydraulic oil in the circuit, which allows for wear-free braking.

In an embodiment of the invention, the transmission can have a drive shaft to which both the primary drive and the secondary drive are coaxially arranged and on which both drives act directly. The construction cost of the drive unit is thereby simplified, with the advantage that the manufacturing cost of a disc chipper according to the invention is kept as low as possible and a compact design is obtained.

The transmission can be a gear transmission, which enables the transfer of large forces with low wear. In another embodiment, the transmission is formed by a belt transmission, which can be produced relatively inexpensively. A transmission ratio can be between 5:1 and 6:1, in order to operate the primary drive in the optimum range at the predetermined rotational speed of the chipping disc.

To transmit the driving force from the rotor shaft to the chipping disc, the rotor shaft according to the invention comprises a bearing seat for the chipping disc, having a polygonal cross section. In connection with a complementary-shaped centric through-hole in the chipping disc, the existing drive torque is transmitted over large areas of contact. This has the advantage that even very high drive and/or acceleration forces can be transmitted without overtaxing the materials in the contact area. This creates power reserves in the contact area, which can be advantageously used to increase the engine power and consequently to improve the efficiency of a disc chipper according to the invention. To this end, bearing seats with point or axisymmetric cross sections have proven to be advantageous, such as square, pentagonal, hexagonal or octagonal cross-sections, which cause a uniform power transmission over the circumference of the bearing seat.

The bearing seat can have a peripheral bearing flange against which the back of the chipping disc is clamped for attachment to the rotor shaft. The bearing flange thereby forms a spatially defined reference surface, starting from which the blades of the chipping knives are adjusted to a common cutting plane. In this way, it is possible to reproduce uniform geometric relationships during the chipping process for all chipping knives, which results in the wood chips being uniform in size and shape and therefore being characterized by a very high quality.

In order to be able to adjust the geometric conditions on the stator side that are relevant to the chipping process, the stationary counter blades are mounted in rigid receptacles and there, are indirectly supported on stop surfaces in the receptacles via an adjustment device. In this way, it is possible to accurately adjust the axial gap between the chipping knives and the counter knives. By maintaining the optimum cutting geometry, chips with an excellent surface quality can be produced.

A simple yet very robust and reliable type of counter knife adjustment involves the use of spacer plates that are inserted in suitable thickness and number between stop surface and counter knife. A continuous adjustment of the counter knives is carried out according to an alternate embodiment of the invention using adjustment screws that determine the distance between counter knife and stop surface, depending on their insertion depth.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1B:
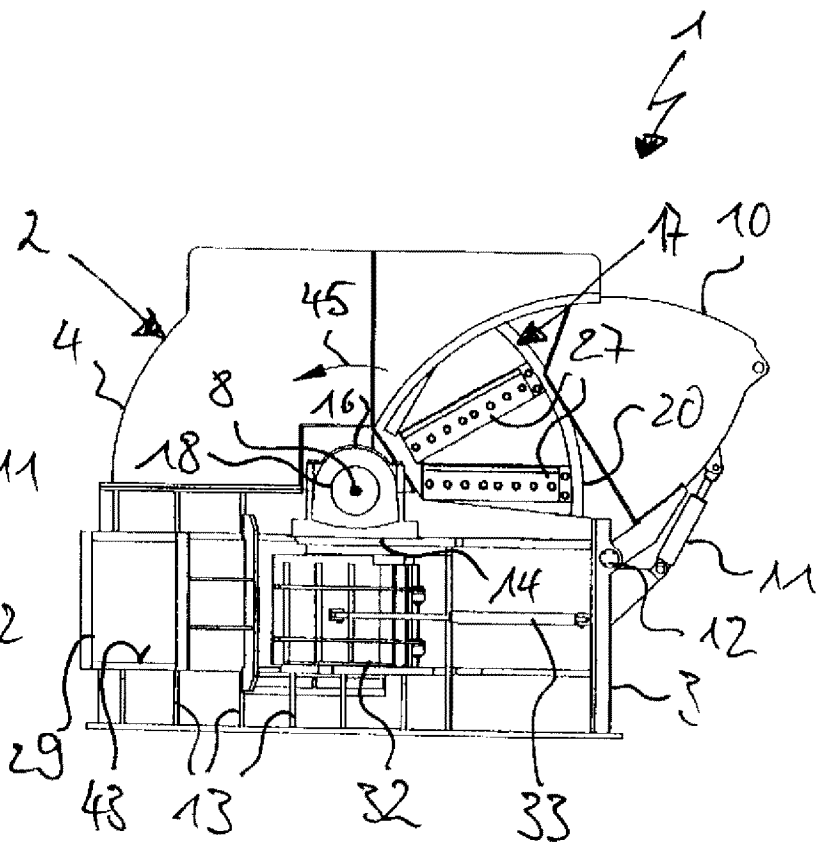
FIG. 1*b* illustrates the disc chipper shown in FIG. 1 with open housing.
Figure 1A:
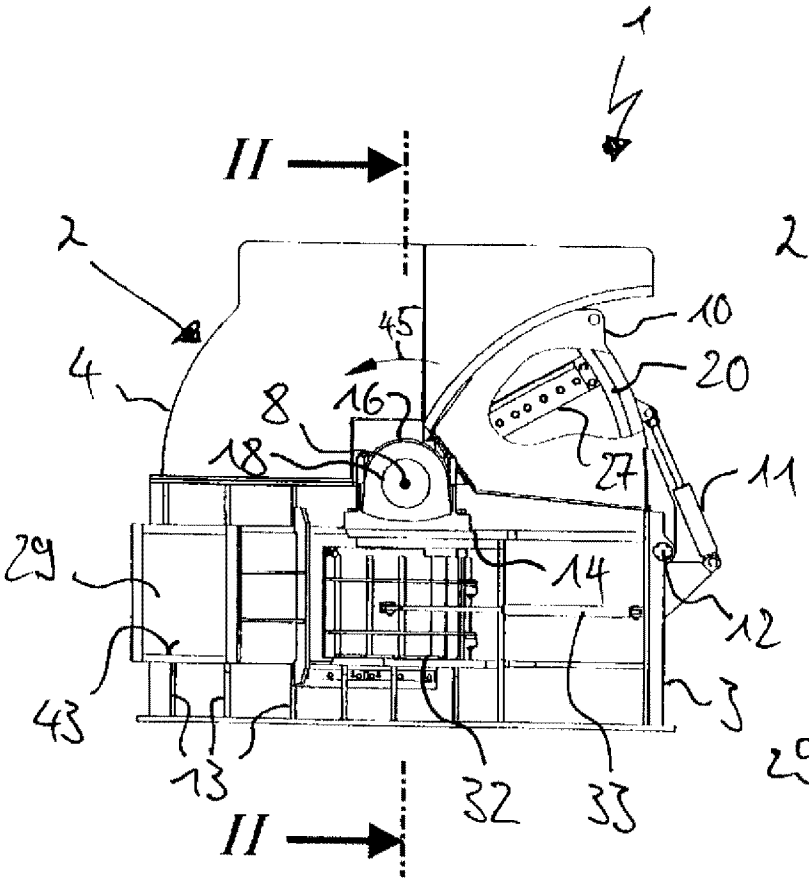
FIG. 1*a* a side view of an inventive disc chipper with a closed housing.

FIGS. 1*a*, 1*b*, 2 and 3 show a disc chipper 1 according to the invention in different views and sections. The disc chipper 1 has a housing 2, which is composed of a lower part 3 and a hood-like upper part 4. The housing 2 has a front wall 5 and a rear wall 6 plane-parallel thereto, which are connected via a cylindrical housing shell 7 and in this manner enclose a downwardly open comminuting chamber 9 which extends along an axis 8. The housing upper part 4 is formed of a housing segment 10 via a sector-shaped portion, which, driven by a cylinder-piston assembly 11, can be pivoted about the axis 12 in order to open the housing 2, for example, for maintenance or repair work. The lower housing part 3 is reinforced by a number of rib-shaped stiffening plates 13.

In the transition area between the lower part 3 and the upper part 4, in each case a console 14 is secured on the outside front wall 5 and the rear wall 6, on each of which a pivot bearing 15, 16 is positioned for receiving a crushing rotor 17 that rotates about the axis 8. The crushing rotor 17 has a rotor shaft 18, which shaft end associated with the front wall 5 is supported by the local pivot bearing 16, and which other end is passed through the pivot bearing 15 and attached to a drive described in particular in more detail in FIG. 3.

Figure 2:
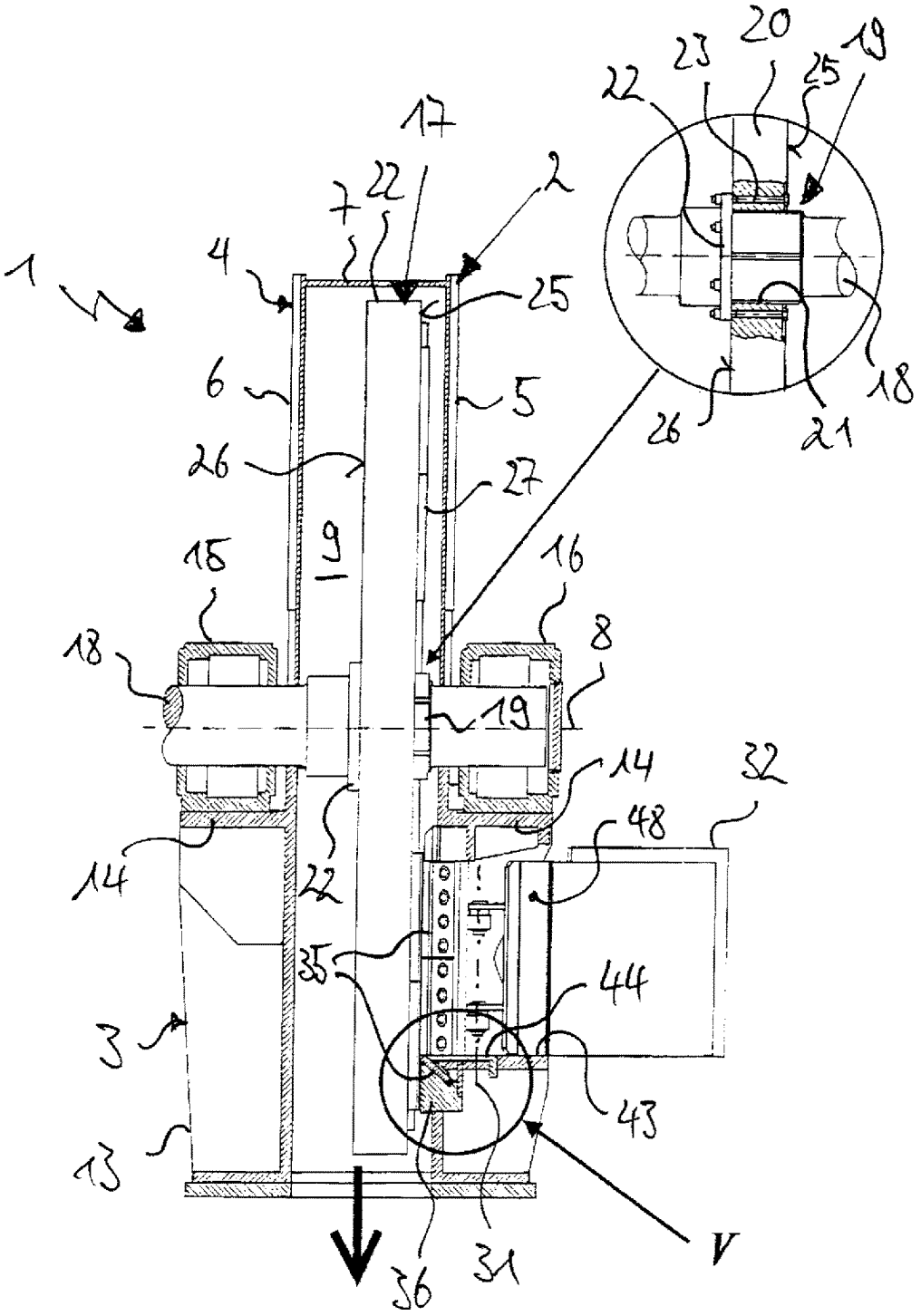
FIG. 2 is a section through the disc chipper shown in FIG. 1, along the local line II-II.

The shaft section extending within the housing 2 forms a bearing seat 19 for a chipping disc 20 oriented perpendicular to the axis 8, which, for example, may comprise a diameter of about 2.5 m and a weight of about 10,000 kg. The chipping disc 20 has a centric through-hole 21 with which it is mounted on the bearing seat 19. For exact axial positioning of the chipping disc 20, the bearing seat 19 has a bearing flange 22 encircling the shaft circumference, which seat delimits the axial insertion depth of the chipper disc 20. The chipping disc 20 is clamped against the bearing flange 22 by means of the screws 23 (FIGS. 2 and 4*a*).

To transmit the torque from the rotor shaft 18 to the chipping disc 20, the bearing seat 19 is designed as a hexagon and the through-hole 21 of the chipping disc 20 has an outline complementary thereto. In this way, relatively large force transfer surfaces result that are also capable of transferring great driving forces as they occur especially in chipping discs with large weight and large diameter, without overstressing the material.

Figure 4A:
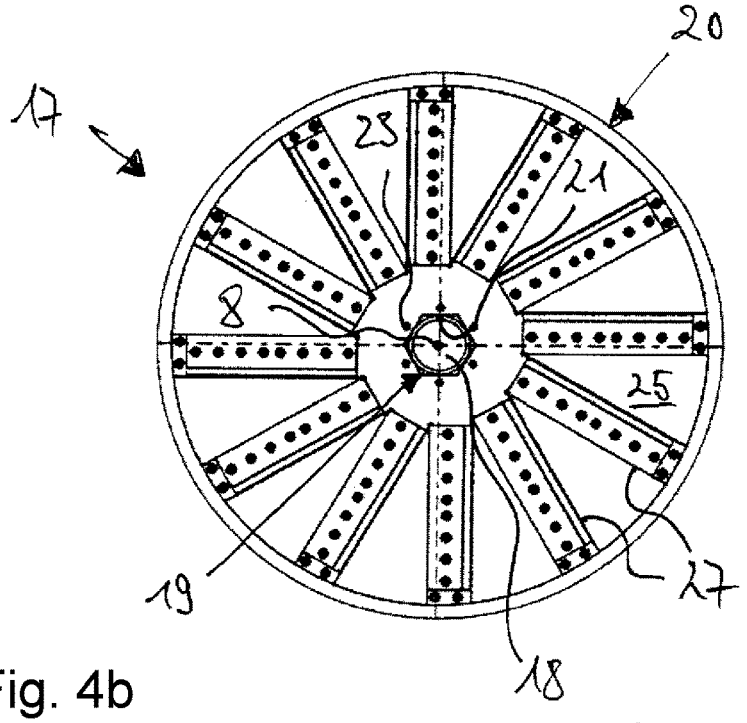
FIG. 4*a* is a view of the front side of the chipping disc of the disc chipper shown in FIG. 1.
Figure 4B:
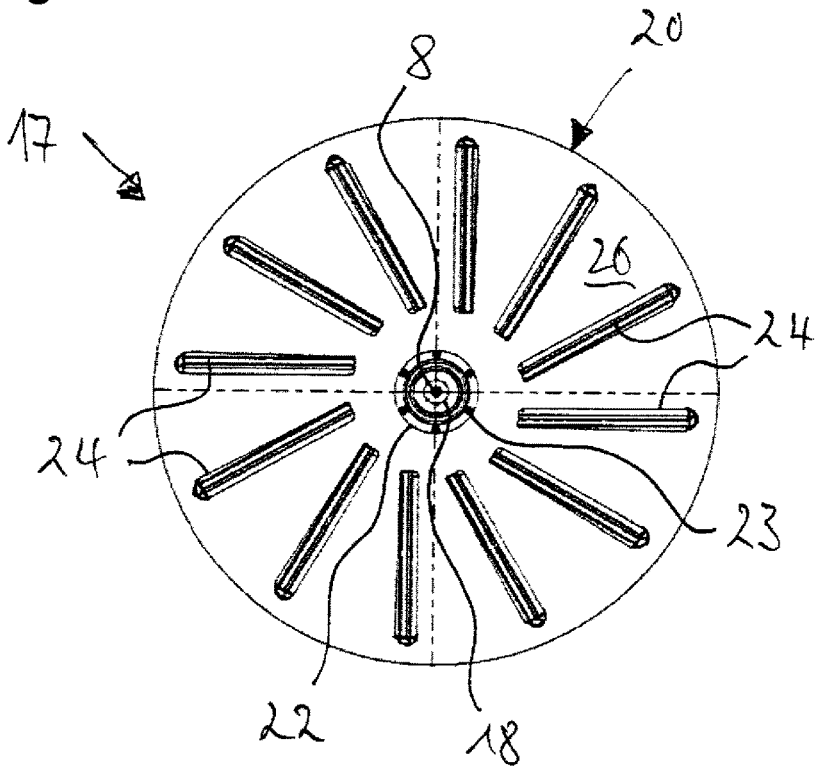
FIG. 4*b* is a view of the back side of the chipping disc shown in FIG. 4*a*, and FIG. 5 a detailed view of the region marked in FIG. 2 with V.

The more precise design of the chipping disc 20 is also shown in FIGS. 4*a* and 4*b*. The chipping disc 20 has a number of linearly extending passage gaps 24 reaching from the disc front side 25 to the disc back side 26 and which extend star-shaped from the near-axial inner disc portion to the near outer disc portion (FIG. 4*b*). On the disk front side 25 along each passage gap 24, a chipping knife 27 is arranged which with a predetermined blade projection protrudes from the plane of the chipping disc 20 and guides the freshly obtained chips into the passage gap 24. The blades of all chipping discs 27 thus lie on a common plane, plane-parallel to the disc plane. For producing high-quality wood chips, it is important that the chipping knives rotate in exactly this plane.

For the loading of the disc chipper 1 with feed indicated by arrow 34, a housing opening 28, into which a horizontal feed chute 29 opens extending at an acute angle to the disc plane, is disposed at the front wall 5 of the housing 2 approximately centrally below the pivot bearing 15. Opposite the housing opening 28, the feed chute 29 has an opening 30, which is closable by a pivotable flap 32 about an axis 31. The opening and closing of the flap 32 is carried out by means of a cylinder-piston unit 33, which is hinged both on the housing 2 and on the flap 32.

Figure 5:
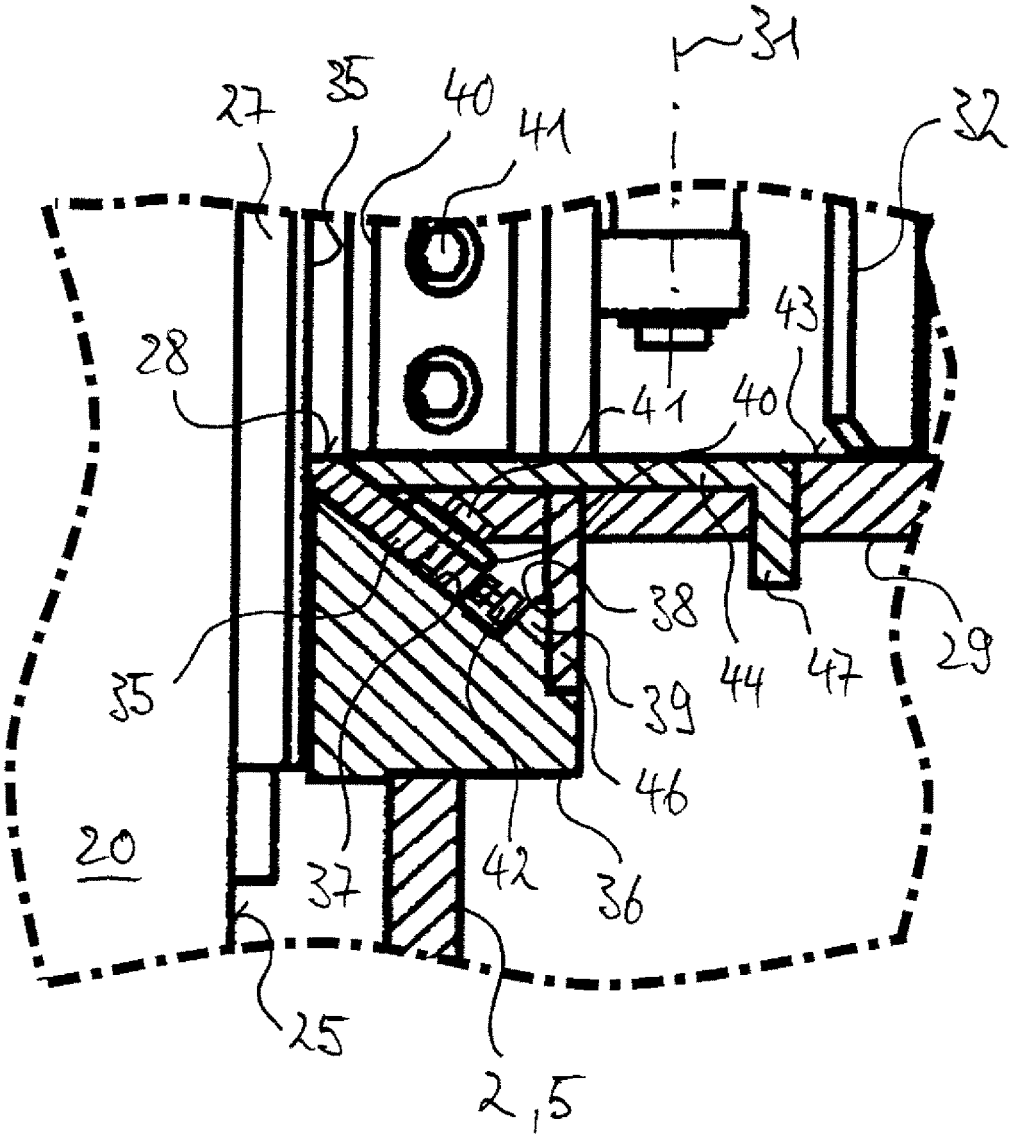

Counter knives 35 cooperating with the chipper knives 27 extend along the lower horizontal edge and the vertical edge of the housing opening 28 that adjoins in the direction of rotation 45. As shown particularly in FIG. 5, for this purpose receptacles are provided in these areas, which are each welded in the form of a rigid bearing beam 36 with the front wall 5 of the housing 2 and of which the side facing the housing opening 28 is formed by an inclined bearing surface 37. Along the edge of the bearing surface 37 facing away from the housing opening 28, a strip-shaped extension 39 extends to form a stop surface 38.

The counter knife 35 rests with its planar side full-surface on the bearing surface 37 and is fixed via a clamping strip 40 and a number of clamping screws 41 on the bearing beam 36. So that the counter knives 35 are arranged at the exact axial distance from the chipping knives 27, an adjusting device is provided on the back side of the counter knives 35 facing the stop surface 38, said adjusting device being supported by the stop surface 38. In the present embodiment, the adjusting device includes two adjusting screws 42 arranged at a lateral distance, each engaging with its threaded portion in threaded holes at the rear side of the counter knives 35, and each being supported by their screw head on the stop surface 38. By a suitably wide screwing-in or unscrewing of the adjustment screws 42, the distance between the counter knives 35 from the stop surface 38 and thus the distance of the blades of the counter knife 35 from the chipping knives 27 can be adjusted. Setting the correct insertion depth of the adjustment screws 42 can be done via a lock nut or a suitable number of spacer plates between the back side of the counter knives 35 and the screw head.

Accessibility to the horizontal counter knives 35 near the bottom 43 of the feed shaft 29 is ensured there by a provided opening, which is filled by a removable first cover plate 44. With its front edge, the first cover plate 44 joins gap-free to the counter knife 35, while the opposite rear edge is supported on the opening edge. To support the first cover plate 44 perpendicular to the display plane, a supporting plate 46 approximately centrally supporting the first cover plate 44 is provided on the support beam 36, and the rear edge of the first cover plate 44 is reinforced by arranging a rib 47.

In the region of the vertical counter knives 35, these are protected by a second removable cover 48 which is integrated in the flap 32 and in the course of opening the flap 32, releases the vertical counter knives 35. The second cover 48 includes a plate that is rigidly welded to the outside of the flap 32 along the flap edge facing the hinge region, perpendicular to the flap plane, and that in the course of closing the housing opening 28 covers the vertical counter knives 35.

Figure 3:
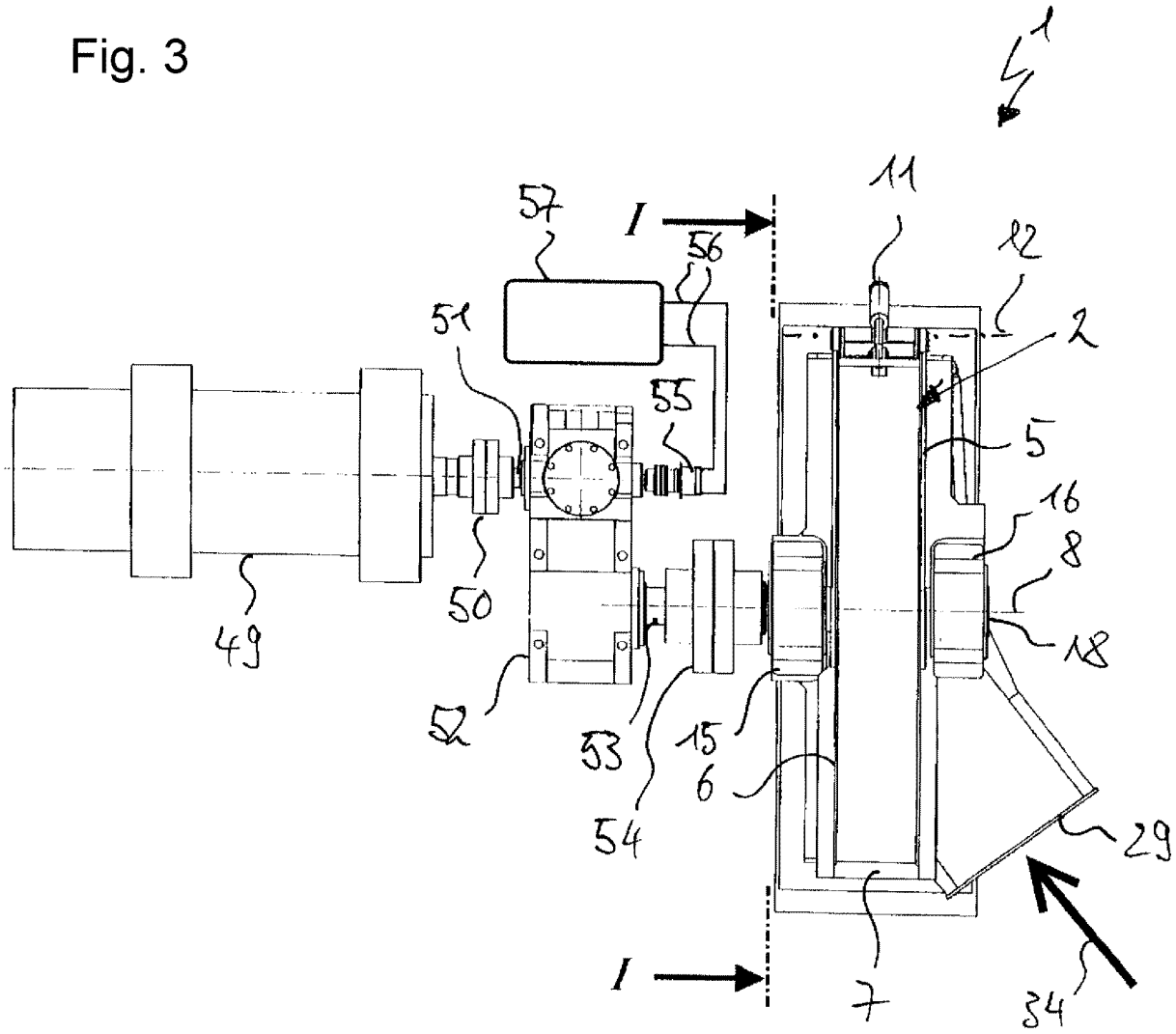
FIG. 3 is a plan view of the disc chipper shown in FIG. 1, including the drive unit.

An inventive drive unit as shown in FIG. 3 in a plan view drives the chipping disc 20. The drive unit comprises an electric motor 49 as a primary drive, which shaft is aligned coaxially to the drive shaft 51 of a transmission 52 and acts directly via a first clutch 50 on the drive shaft 51. The output shaft 53 of the transmission 52 is in turn coupled via a second coupling 54 with the rotor shaft 18 that is driving the chipping disc 20. The two clutches 50 and 54 are each composed of two coaxially opposed clutch discs, at which sides facing each other resilient carriers and openings are alternately arranged. Through a mutual offset of the clutch plates in the circumferential direction, when merging the clutch plates, the carriers of the one clutch disc position themselves in the openings of the other clutch disc. Because of the toothing thereby formed, torques can be transmitted. Within the transmission 52, the rotational speed of the electric motor 49 is decelerated at a ratio of 5:1 to 6:1 into a rotational speed of about 300 rev/min on the output side, which corresponds to the speed of the chipper disc 20. The output of the primary drive thereby amounts to 1400 kW.

On the opposite side of the transmission 52, a hydraulic motor 55 is arranged as a secondary drive, which shaft that is coaxial to the drive shaft 51 is directly coupled to the drive shaft 51. The hydraulic motor 55 is connected via hydraulic lines 56 to a hydraulic unit 57 having pumps and an oil tank. The output of the secondary drive amounts to 45 kW.

In order to bring the inventive disc chipper 1 into the operating state, the chipping disc 20 is accelerated by means of the secondary drive to the rotational speed at which the disc chipper 1 is later operated in the chipping operation. During acceleration, the primary drive is turned off, that is, the rotor of the electric motor 49 remains passive and is only set in rotation by the hydraulic motor 55 together with the chipping disc 20. When the predetermined operating speed is reached, the secondary drive is switched off and the primary drive is switched on. Thus, during the chipping operation, the secondary drive is driven by the primary drive, without participating in driving the chipping disc 20. Only in the braking phase of the chipping disc 20 is the hydraulic motor 55 again turned on, after the primary drive has been previously switched off. The hydraulic oil pumped in the circuit by the hydraulic motor 55 carries out the braking process.

If maintenance or repair work are to be done on the chipping disc 20, for example, when worn chipping knives 27 must be replaced by sharpened ones, the secondary drive can also be used for the gradual adjustment of the chipping disc in the respective blade change position without the need for the primary drive to be enabled.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A disc chipper for the comminution of lumpy feed material, the disc chipper comprising:

a crushing rotor driven by a drive unit and rotating about an axis;

a rotor shaft;

a chipping disc connected in a rotationally fixed manner with the rotor shaft, the chipping disc having chipping knives that are transversely aligned in the disc plane to the rotational direction and that cooperate with stationary counter knives for the comminution of the feed material; and the drive unit including a primary drive and a secondary drive, which drive the crushing rotor via a transmission, the primary drive being in active operative connection with the crushing rotor during a crushing operation and the secondary drive being in active operative connection with the crushing rotor during an acceleration process, wherein the primary drive comprises an electric motor, and wherein the secondary drive accelerates the chipping disc to a rotational speed at which the disc chipper is to be operated during the crushing operation.

2. The disc chipper according to claim 1, wherein the secondary drive comprises a hydraulic motor.

3. The disc chipper according to claim 1, wherein the primary drive and the secondary drive are arranged coaxially to a drive shaft of the transmission and are coupled thereto.

4. The disc chipper according to claim 1, wherein the transmission is a gear transmission or a belt transmission.

5. The disc chipper according to claim 1, wherein the transmission has a gear ratio of between 5:1 and 6:1.

6. The disc chipper according to claim 1, wherein the primary drive has a power P of between 450 kW and 1500 kW or between 900 kW and 1400 kW.

7. The disc chipper according to claim 1, wherein the secondary drive comprises a power P of between 25 kW and 75 kW or between 35 kW and 55 kW.

8. The disc chipper according to claim 1, wherein the chipping disc has a weight of at least 5,000 kg, of at least 7,500 kg, or a minimum of 10,000 kg.

9. The disc chipper according to claim 1, wherein a rigid receptacle with a bearing surface and a stop surface is arranged in a region of the chipping disc, and wherein a flat side of the counter knives are arranged on the bearing surface and a longitudinal edge of the counter knives, situated opposite a blade of the counter knives, indirectly abut against the stop surface via an adjusting device, and wherein the adjusting device has an adjuster for adjusting a relative position of the counter knives in the receptacle.

10. The disc chipper according to claim 9, wherein the adjuster comprises at least one spacer plate which is disposed between the longitudinal edge of the counter knives and the stop surface of the receptacle.

11. The disc chipper according to claim 9, wherein the adjuster comprises at least one screw which can be screwed into a threaded bore that extends transverse to the longitudinal edge of the counter knives and a head of the at least one screw bears against the stop surface of the receptacle.

12. The disc chipper according to claim 1, wherein the rotor shaft, in a region of a bearing seat for the chipping disc, has a polygonal cross section and the chipping disc has a centric through-hole having a polygonal cross section that corresponds to the polygonal cross section of the rotor shaft.

13. The disc chipper according to claim 12, wherein the polygonal cross section of the rotor shaft, in the region of the bearing seat for the chipping disc, is an equilateral and/or equiangular polygon, a square, a pentagon, a hexagon or an octagon.

14. The disc chipper according to claim 12, wherein the rotor shaft, in the region of the bearing seat, has a radially-extending bearing flange, wherein a back side of the chipping disc, that faces away from the chipping knives, rests against the bearing flange.

15. The disc chipper according to claim 1, wherein the counter knives include first counter knives that are arranged at an angle to second counter knives, wherein the second counter knives are arranged substantially parallel to the chipping knives.

16. The disc chipper according to claim 15, wherein the first counter knives are supported between a bearing beam and a cover plate, wherein the cover plate is supported with respect to the bearing beam by a support plate that extends perpendicular to the cover plate, and wherein one end of the support plate directly contacts the cover plate and a second end of the support plate directly contacts the bearing beam.

* * * * *